United States Patent [19]

Dahlgren et al.

[11] Patent Number: 4,532,735

[45] Date of Patent: Aug. 6, 1985

[54] VARIABLE ANGLE EXTRUDER BLADE SURFACING MACHINE

[75] Inventors: Harold P. Dahlgren; James E. Taylor, both of Dallas; Dwight W. Peters, Grapevine; Donald R. Selby, Duncanville, all of Tex.

[73] Assignee: Dahlgren Manufacturing Company, Dallas, Tex.

[21] Appl. No.: 371,521

[22] Filed: Apr. 26, 1982

[51] Int. Cl.[3] ..... B24B 9/04

[52] U.S. Cl. ..... 51/56 R; 51/218 A

[58] Field of Search ..... 51/56 R, 218 R, 218 A, 51/217 A, 216 A, 249, 240 A

[56] References Cited

U.S. PATENT DOCUMENTS

| | | | |
|---|---|---|---|
| 234,299 | 11/1880 | LeRoy | 51/249 |
| 550,695 | 12/1895 | Schlegel | 51/56 |
| 1,172,183 | 2/1916 | Wardwell, Jr. | 51/249 |
| 1,199,672 | 9/1916 | Dick | 51/56 |
| 2,069,097 | 1/1937 | Root | 51/56 |
| 2,738,625 | 3/1956 | Strnad | 51/56 |
| 2,990,729 | 7/1961 | Zernov | 51/218 R |

FOREIGN PATENT DOCUMENTS

| | | | |
|---|---|---|---|
| 0668905 | 6/1929 | France | 51/218 R |

*Primary Examiner*—Frederick R. Schmidt
*Assistant Examiner*—Robert A. Rose
*Attorney, Agent, or Firm*—Gerald G. Crutsinger; John F. Booth; Monty L. Ross

[57] ABSTRACT

A blade surfacing machine for precisely honing a pair of intersecting surfaces on an extruder blade. The working surface of a rotating honing stone is maintained in spring-biased contact with a precisely leveled guide surface to achieve linear uniformity of the blade. A workholder table is pivotable about a horizontal axis and may be pin locked at selectable angles to produce blades having a selective angle of intersection between the two honed surfaces.

14 Claims, 9 Drawing Figures

VARIABLE ANGLE EXTRUDER BLADE SURFACING MACHINE

BACKGROUND

This invention relates to surface grinding machines, and more particularly, to a machine for honing a pair of precision surfaces on an extruder blade member to a precise selectable included angle between the surfaces.

Extruder blades are used to meter ink from a reservoir onto a resilient surfaced roller in printing press inkers of the type disclosed in U.S. patent application Ser. No. 06/282,294 filed July 13, 1981, entitled "Ink Metering Apparatus With Obtuse Metering Member", now abandoned. The thickness of the ink layer maintained on the resilient surface of the roller is dependent on the angle between the two surfaces on the extruder blade adjacent the roller surface. The uniformity of the ink film thickness is dependent upon the linear trueness of the extruder blade edge between the two surfaces over the length of the blade.

Extruder blades of this type are typically from about ten to forty inches long, but some applications may require blades of up to 80 inches or more in length. The precise requirements for such extruder blades or metering members are discussed in more detail in U.S. patent application Ser. No. 06/282,294, the disclosure of which is incorporated herein by reference in its entirety for all purposes. This application is assigned to the assignee of the present invention.

Previously, the metering surface and the support surface, which meet to form the metering edge on the blade, were honed by hand methods. The accuracy of such a hand process was susceptible to improvement.

BRIEF DESCRIPTION OF THE INVENTION

The present invention provides a blade surfacing machine wherein a work holder table is rotatable about a horizontal axis and with respect to a honing stone guide surface. The work table may be pin locked at selectable precise angles whereby the blade surfaces may be honed to a consistently precise angle uniformly through one or several production runs of blades. Moreover, the surfacing machine of the present invention may be used to produce blades having different selectable angles between the two honed surfaces for successively produced blades without sacrificing precision or operating facility.

Linear uniformity of the honed surface of the blade is achieved by precise guidance of a rotating honing stone through its mechanized traverse of the blade surface. This precise guidance is realized by maintaining a large area of the working surface of the honing stone in spring biased contact with a precisely leveled and flat hardened or plated guide surface accurately locatable with respect to the work table of the surfacing machine.

Thus, it is an object of the present invention to provide a surfacing machine for the production of smooth and polished, uniformly accurate extruder blade surfaces, said surfaces being honed to an RMS surface roughness of less than RMS 4 microinches.

It is a further object to provide a surfacing machine for the precision honing of extruder blade surfaces to accurate selectable angles of intersection.

It is another object to provide a surfacing machine for the honing of plural surfaces on an extruder blade without relocation of the blade on the work table or relocation to another honing fixture for each surface to be ground.

It is an even further object to provide a surfacing machine for honing linearly uniform surfaces on extruder blades of up to 80 or more inches in length.

These and other objects and advantages of the present invention will become apparent from the following detailed description when read with reference to the accompanying drawings.

BRIEF DESCRIPTION OF THE DRAWINGS

Drawings of a preferred embodiment of the invention are annexed hereto so that the invention may be better and more fully understood, in which.

The same numeral references are employed to designate like parts throughout the various figures of the drawing.

DETAILED DESCRIPTION

Figure 1:
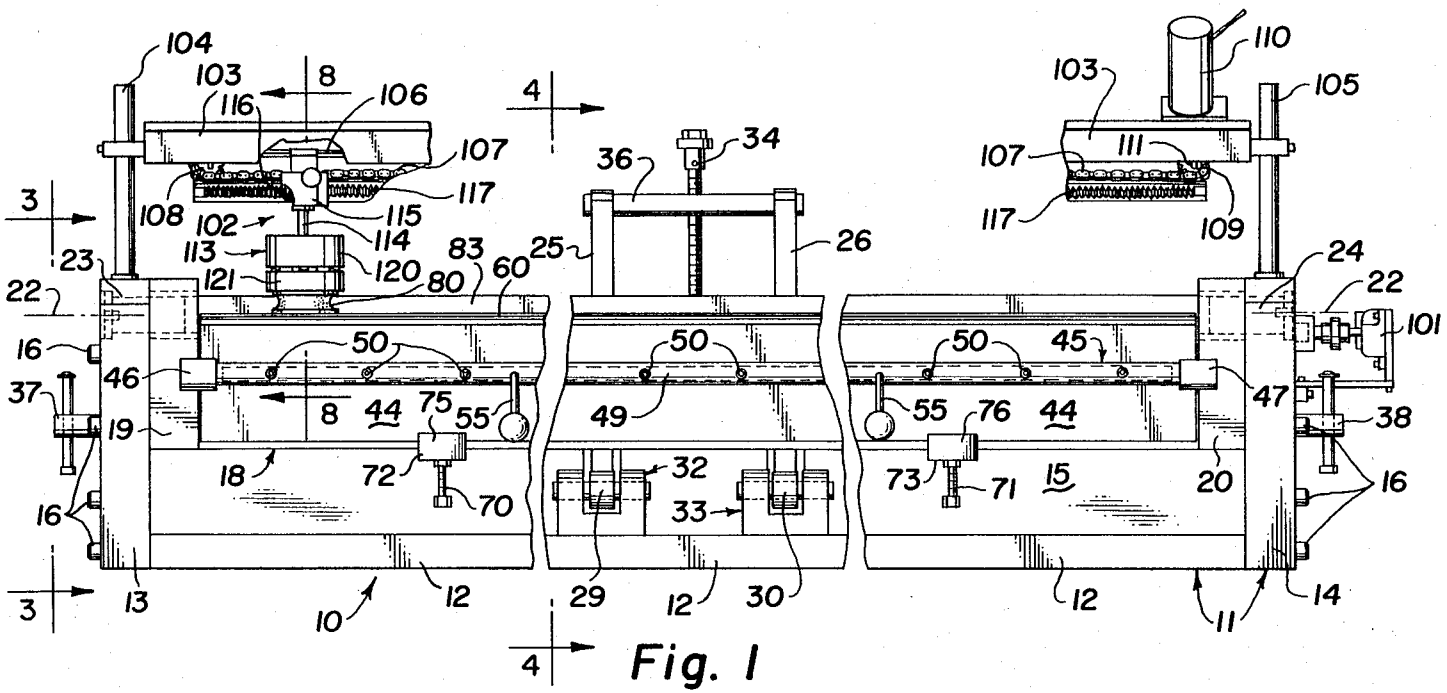
FIG. 1 is a fragmentary front elevational view of the surfacing machine of the present invention.

With reference now to the drawings and particularly to FIGS. 1–5, a preferred embodiment of the surfacing machine 10 comprises a frame 11 having a base plate 12 and spaced end plates 13 and 14 together with a back plate 15. The plates 12-15 are connected together by bolts 16 to form the frame 11. Dowel pins 17 provide accurate assembly of the frame 11. A movable work table 18 mounted between end brackets 19 and 20 is rotatable about the horizontal axis 22 through pins 23 and 24 mounted in the end plates 13 and 14, respectively. Positive support of the midsection of work table 18 is provided by its attachment by bolts 21 to swing plates 25 and 26, the peripheral surfaces 27 and 28 of which ride on rollers 29 and 30, respectively. The structure of the bearing assemblies 32 and 33 for rollers 29 and 30 may be of any type providing adequate strength and accuracy for purposes of the present invention. The peripheral surfaces 27 and 28 of swing plates 25 and 26 form an accurate circular arc segment centered about the horizontal axis 22.

The tilt angle of the work table 18 is adjusted by rotation of the lead screw 34. Lead screw 34 is pivotally anchored to back plate 15 of frame 11 by bracket assembly 35 and is coupled to swing plates 25 and 26 through threaded engagement with cross bar 36 rotatably mounted between the swing plates.

Figure 3:
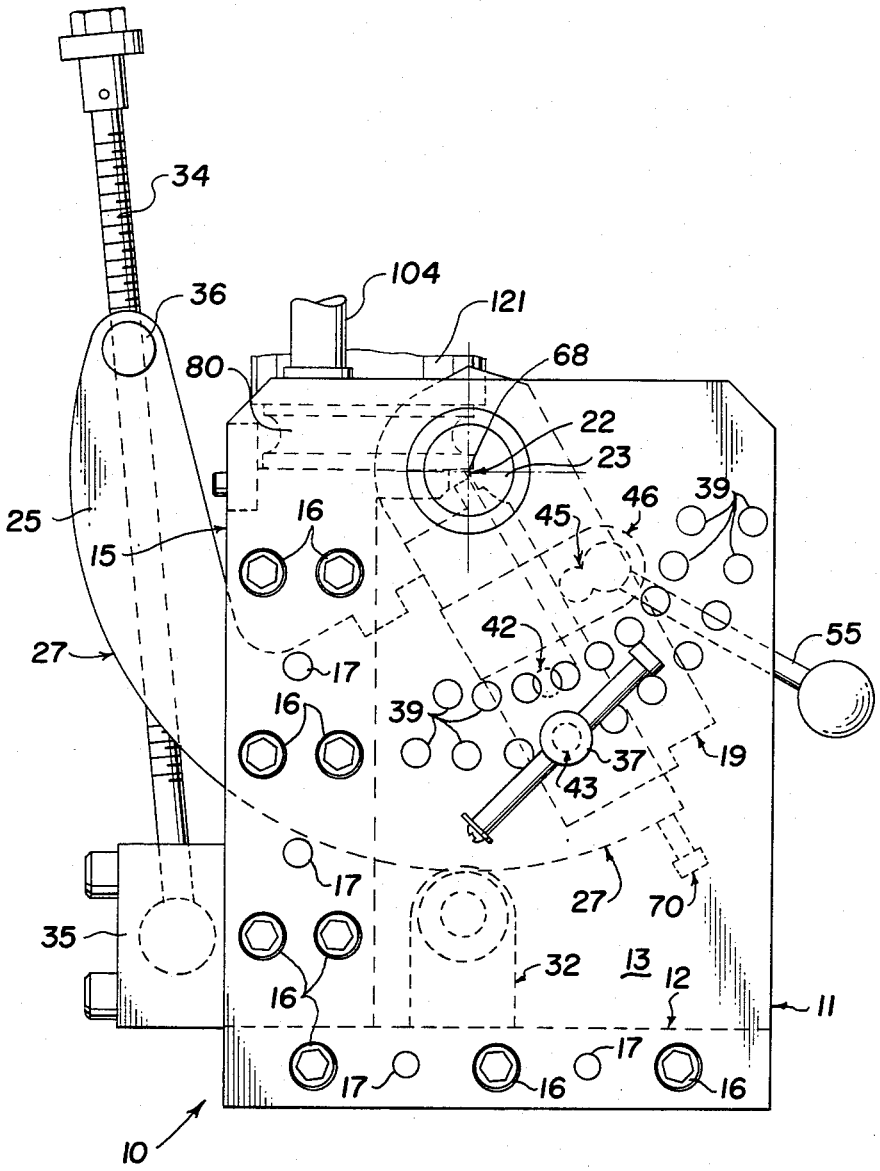
FIG. 3 is an enlarged fragmentary side elevation view of the surfacing machine of the present invention taken from lines 3—3 of FIG. 1.

Precise location and locking of the work table 18 to a desired tilt angle with respect to a reference plane containing axis 22 is accomplished by locator pins 37 and 38 inserted through appropriately positioning holes 39 and 40 accurately machined in side plates 13 and 14 and into the locator holes 42 or 43 in the end brackets 19 and 20. The positioning holes 39 and 40 are located to provide five-degree precise increments in the tilt angle of work table 18. The left most positioning hole 39, as viewed in FIG. 3, is used to locate the work table 18 in a vertical position; the positioning hole shown just above and to the right is used to set the work table at a five degree angle with the vertical. The top positioning hole on the right of end plate 13, as viewed in FIG. 3, will position the work table 18 in a horizontal position or 90 degrees from vertical.

Figure 4:
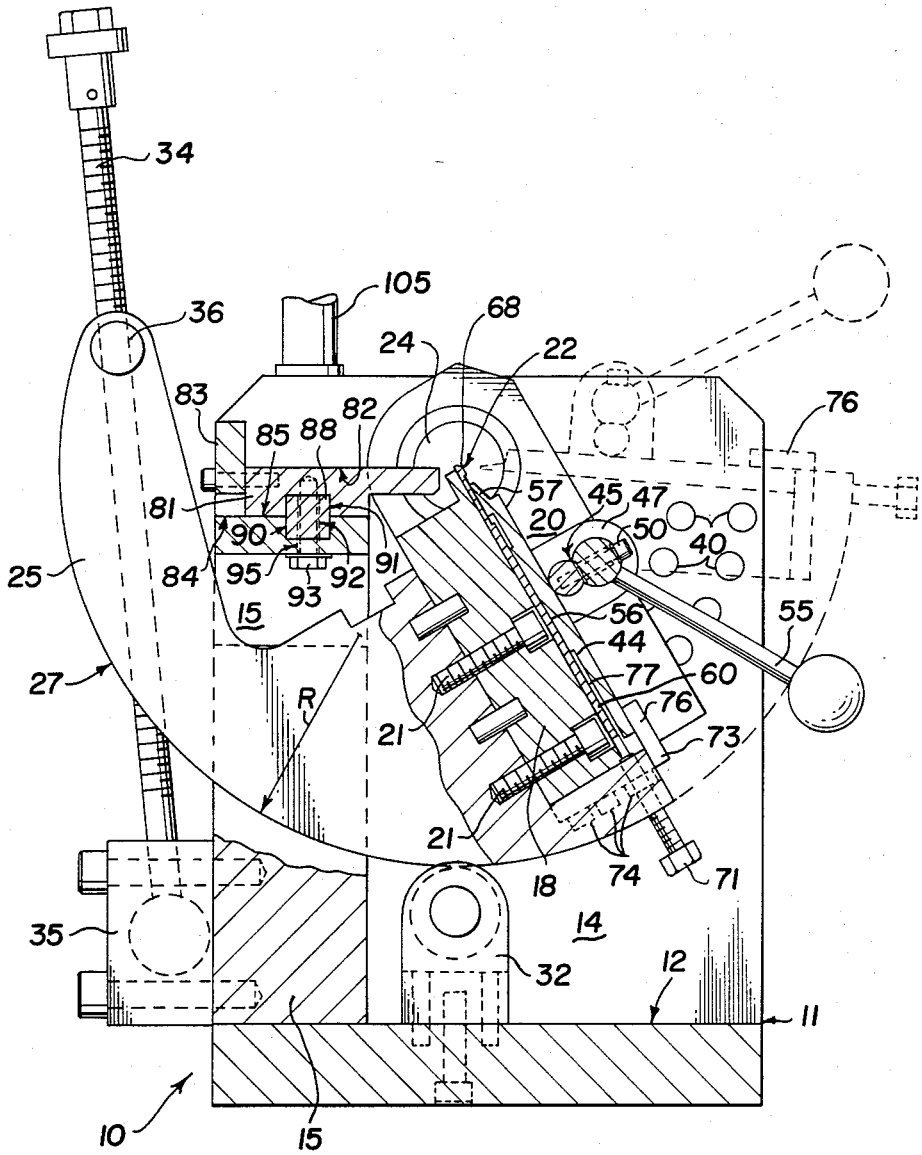
FIG. 4 is an enlarged fragmentary cross-sectional view of the surfacing machine taken along lines 4—4 of FIG. 1, parts being broken away to more clearly illustrate details of construction.
Figure 6:
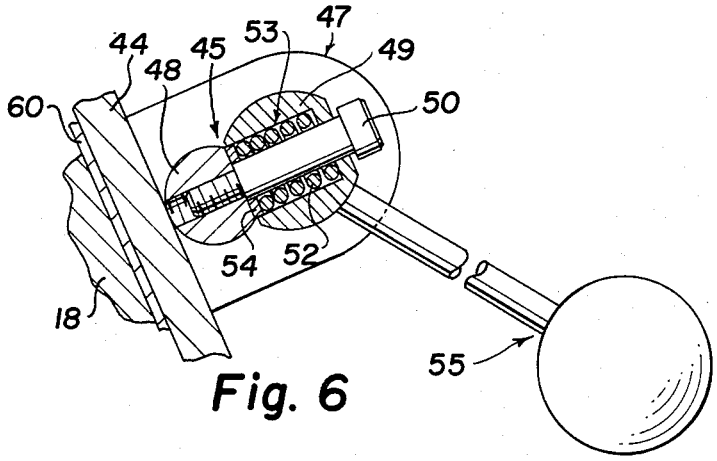
FIG. 6 is a detailed section of the work table clamp bar of the surfacing machine of the present invention.

An extruder blade 60 to be surfaced is clamped between work table 18 and clamp plate 44 by a clamping bar 45. Clamping bar 45 is rotatably mounted in mounting blocks 46 and 47 secured to end brackets 19 and 20. As shown in the detailed cross-section of FIG. 6, clamping bar 45 comprises two main components; a contact rod 48 and a pressure rod 49. The axis of rotation of the clamping bar is along the center line of the pressure rod 49. These two rods are connected at intervals along their lengths in a spring biased arrangement wherein bolts 50 passing through pressure rod 49 hold contact rod 48 against the pressure of partially compressed springs 52 housed in recesses 53 and bearing against washers 54. Handles 55 are used to rotate the clamping bar 45 to bring contact rod 48 to bear uniformly against clamp plate 44 over its full width. The clamping bar 45 is locked into position of maximum pressure, that is with bolts 50 essentially perpendicular to the clamp plate 44 and with springs 52 urging contact rod directly against the plate 44 as shown in FIGS. 4 and 6.

Figure 7:
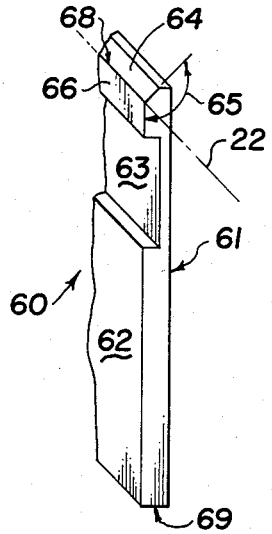
FIG. 7 is a perspective end view of an extruder blade of the type advantageously surfaced by the machine of the present invention.

Extruder blades 60, prior to being mounted on the machine of the present invention for surfacing have been cut and ground to the general configuration shown in FIG. 7. The flat back surface 61 of blade 60 rests against the table 18 when the blade is mounted for surfacing. Clamp plate 44 is shaped to make broad surface contact with the main front surface 62 of blade 60 as shown at 56 in FIG. 4. A lip 57 on clamp plate 44 bears against the groove surface 63 of blade 60 to insure that the blade is held rigidly during the surfacing operation.

In mounting an extruder blade 60 on work table 18, its bottom edge 69 is positioned against the ends of micrometer screws 70 and 71. Micrometer screws 70 and 71 are threaded through blocks 72 and 73 mounted to the edge of work table 18 by bolts 74. Micrometer screws 70 and 71 are used to precisely position blade 60 on the work table 18 and to adjust the blade edge to a position of true parallel with the bearing axis 22. As best shown in FIG. 4, micrometer screw blocks 72 and 73 extend above the work table 18 and have flanges 75 and 76 which extend over the clamp plate 44. Cutout regions such as 77 on clamp plate 44 and work table 18 provide clearance for the ends of micrometer screws 70 and 71 beneath the clamp plate 44. After an extruder blade 60 is firmly clamped on work table 18, the work table may be rotated into position for surfacing the blade.

A precise metering edge 68 is formed on blade 60 by honing the metering surface 64 and the support surface 66 to a precise surface roughness of not more than RMS 4 and to a constant included angle 65 between the two surfaces. The honing of these surfaces is accomplished by rotating a fine grit honing stone 80 which travels back and forth along the blade while riding in pressure contact with the surface 82 of a guide plate 81. Guide plate 81 is preferably of hard chrome plated steel having a polished level upper surface 82 of high accuracy. A backing plate 83 is bolted to the back edge of guide plate 81. Guide plate 81 is supported on the top edge surface of back plate 15 of frame 11.

The top edge surface 84 of back plate 15 and the lower surface 85 of guide plate 81 comprise precisely matching inclined planes extending laterally of the surfacing machine 10. Thus, relative horizontal movement between guide plate 81 and back plate 15 laterally of the machine 10 produces vertical movement of the guide plate 81 as matching inclined surfaces 84 and 85 move relative to each other while maintaining the plane of guide surface 82 parallel to the axis 22. Such movement is accomplished by rotation of a lead screw 86 in threaded engagement with the nut block 87 attached to guide plate 81.

Guide plate 81 is guided in its lateral motion along the surface 84 by an elongated key member 88 secured by bolts 89 in a key slot 90 running substantially the full length of surface 84. Key member 88 extends into guide slot 91 along the lower surface 85 of guide plate 81 and by intimate engagement therewith constrains the movement of plate 81 to the desired direction only.

Provision is made to lock the position of guide plate 81 relative to back plate 15 by means of clamp bolts 93, which extending through a washer 97 and which extend from access opening 94 in back plate 15 through narrow longitudinal slots 95 in the top wall of the access opening 94, through slots 92 in the key member 88 and into threaded engagement with the guide plate 81 at the bottom of guide slot 91 as shown at 96.

Figure 2:
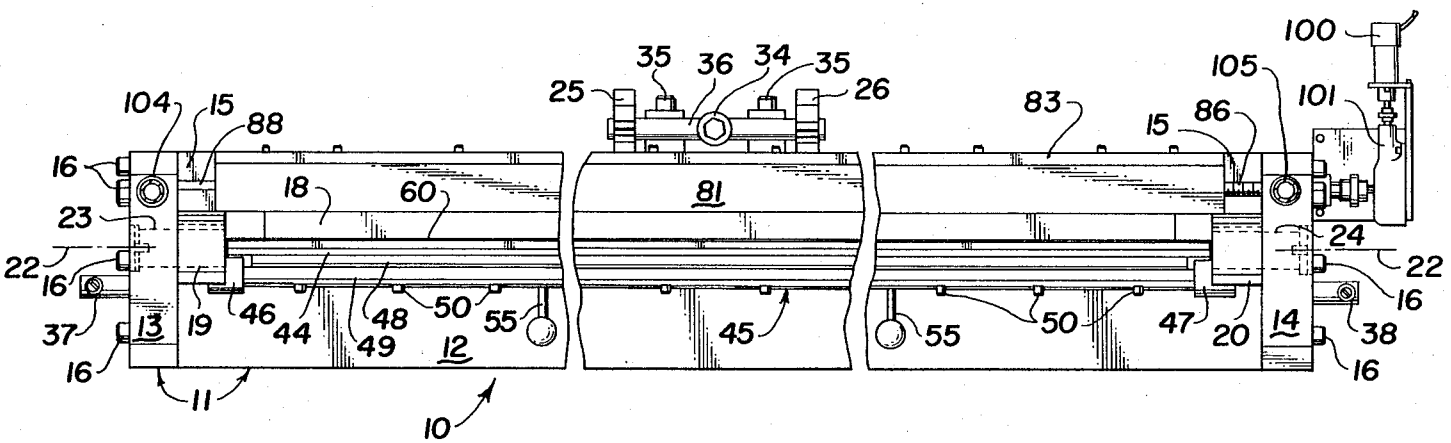
FIG. 2 is a fragmentary top plan view of the surfacing machine of the present invention with the honing stone fixture and drive rack assembly broken away to more clearly illustrate details of construction.
Figure 5:
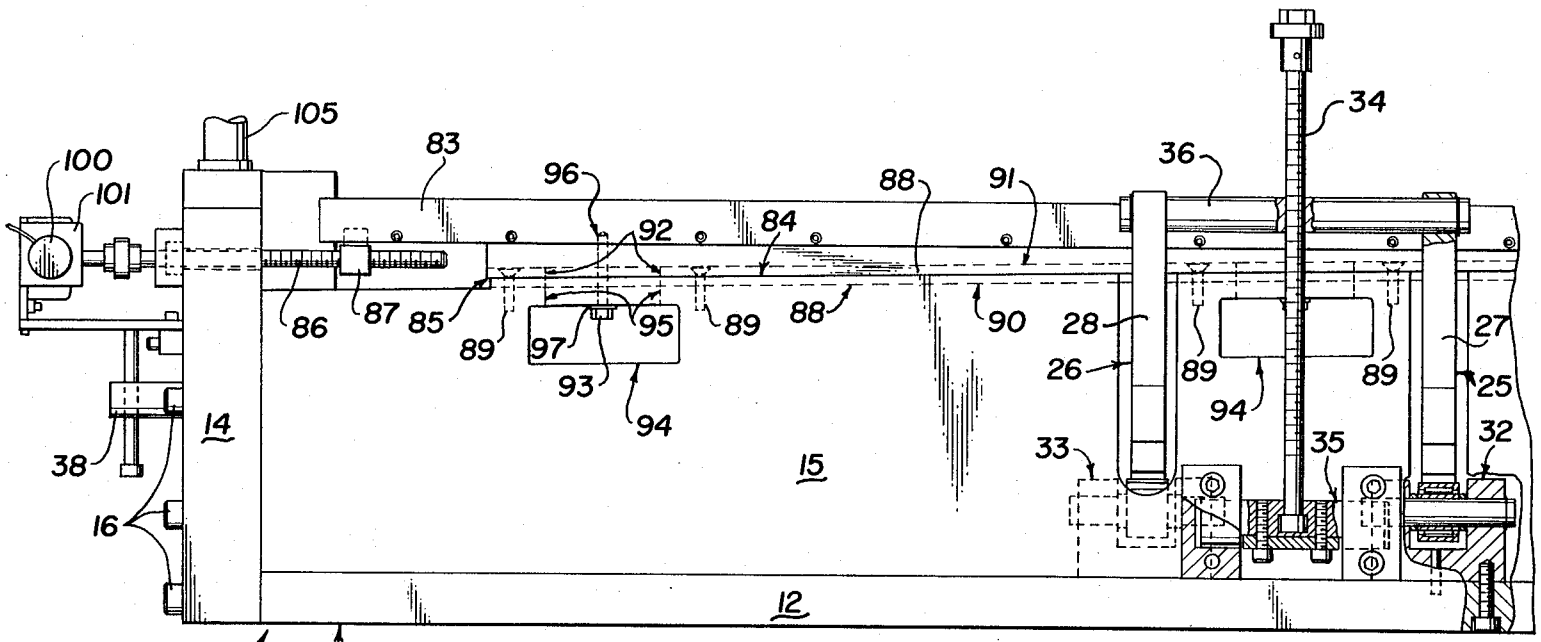
FIG. 5 is an enlarged fragmentary back elevation of the surfacing machine of the present invention with selected areas shown in section.

Extremely slow vertical movement is imparted to guide plate 81 during the blade surfacing operation by an electric motor 100, best illustrated in FIGS. 1, 2, and 5, driving lead screw 86 through reduction gear assembly 101 at a rate of approximately one revolution per hour which results in vertical movement of guide plate 81 at a rate of for example 0.001 inch per hour.

Figure 8:
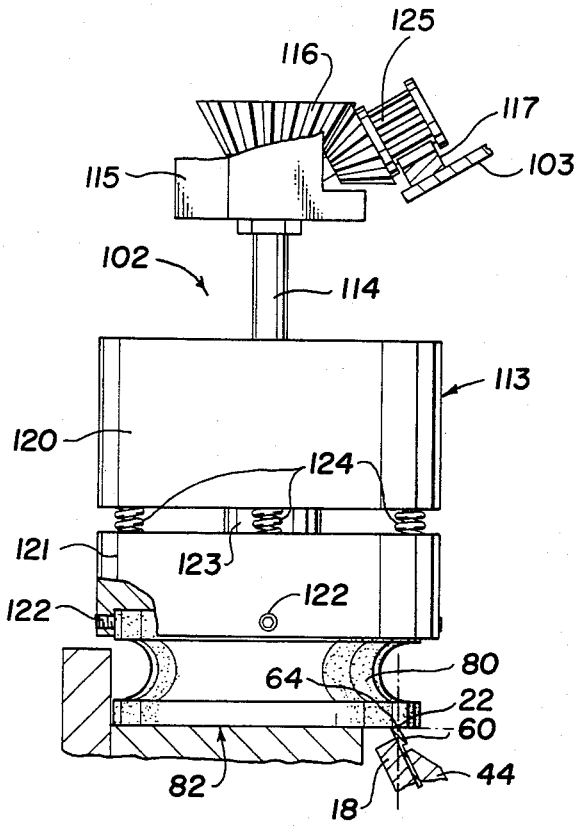
FIG. 8 is an elevation view, partly in section, of the honing stone fixture of the present invention.
Figure 9:
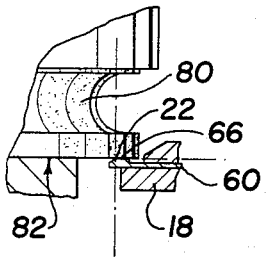
FIG. 9 is a partial elevation view similar to FIG. 8 but showing the workpiece blade in a different position for honing.

As best illustrated in FIGS. 1 and 8, a round honing stone 80 is mounted for rotary and horizontal movement in a honing stone fixture designated generally as 102. Fixture 102 is carried on and driven by the chain drive rack assembly 103 mounted between vertical posts 104 and 105 extending from side plates 13 and 14, respectively. Carriage block assembly 115 of fixture 102 is mounted for lateral movement on a rail member 106. An endless chain 107 mounted between sprockets 108 and 109 is driven in continuous movement by motor and reducer assembly 110 through shaft 111 keyed to the sprocket 109. Fixture 102 is driven in back and forth lateral movement by means of its coupling through the carriage block assembly 115 to a drive link on chain 107.

As best shown in FIG. 8, the honing stone carrier 113 is mounted on the rotatable shaft 114 extending from carriage block assembly 115. A bevel gear 116 is keyed to the other end of the shaft 114 which extends into the interior gear chamber of carriage block assembly 115. The teeth of the bevel gear 116 mesh with the teeth of a bevel-spur gear 125 riding on gear rack 117 positioned on the lower portion of the drive rack assembly 103. Gear rack 117 extends for essentially the full length of the assembly 103. Thus, as carriage block assembly 115 is driven by chain 107 laterally along the length of assembly 113, the bevel gear 116 moving along gear rack 117 imparts rotary motion to shaft 114 and to the honing stone carrier 113 mounted thereon.

Carrier 113 comprises an upper block member 120 which is rigidly mounted on and rotates with the shaft 114. A lower holder block member 121 is adapted to receive and hold a honing stone 80 such as by set screws 122. A coupling shaft 123 between block 120 and holder 121 is keyed to transmit the rotational drive of member 120 to holder 121 while allowing limited free vertical movement of the holder 121. A plurality of compression springs 124, spaced peripherally about the coupling shaft 123 between block member 120 and holder 121, maintain the bottom surface of the honing stone 80 in pressure contact with the upper surface 82 of guide plate 81.

If it is deemed expedient to do so, the outer periphery of honing stone 80 may be urged to engage and roll along the vertically disposed surface on backing plate 83 to impart rotation to the stone. If honing stone 80 is positioned in rolling engagement with plate 83, gears 116, 117 and 125 may be eliminated.

In operating the surfacing machine of the present invention, the extruder blade 60 to be surfaced is mounted on the work table 18 in the manner previously described. With motor 100 and reduction gear assembly 101 decoupled, lead screw 86 is advanced to raise the upper surface 82 of guide plate 81. Thus, the lower surface of honing stone 80 riding on the guide plate 81 is held out of contact with the blade 60 while the blade is positioned for surfacing. The blade 60 may be positioned for honing either the metering surface 64 or the support surface 66 first. Assuming the support surface 66 is to be honed, the work table is tilted to the proper angle, for example, true horizontal, by operation of the lead screw 34 to rotate swing plates 25 and 26. Locator pins 37 and 38 are then inserted through the appropriate positioning holes 39 and 40 into locator holes 42 or 43.

By operation of lead screw 86, guide plate 81 is then lowered until the lower surface of honing stone 80 is just above or just touches the blade surface 66. Motor 100 and reduction gear assembly 101 are then recoupled to the lead screw 86 and the motors 100 and 110 started to begin the surfacing operation.

In the surfacing operation, the honing stone 80 is rotated while being moved laterally back and forth along the length and in contact with the blade surface 66 while riding on the surface 82 of guide plate 81. Motor 100 slowly turns lead screw 86 to lower guide plate 81 until the honing of surface 66 is completed. Thereafter, motors 100 and 110 are stopped, guide plate 81 raised above surface 66 of blade 60 and work table 18 rotated into position for the honing of blade metering surface 64. This position may be with the work table at a 45 degree tilt, for example. With work table 18 properly positioned, locator pins 37 and 38 are again inserted through the proper holes 39 and 40 in end plates 13 and 14 into locator holes 42 or 43. Surfacing of blade surface 64 is then carried out in a similar manner to that described above for the surface 66.

Having described my invention, many changes and modifications still within the spirit and scope of the above teachings will occur to those skilled in the art; therefore, it is to be understood that my invention is to be limited only as set forth in the following claims:

We claim:

1. A blade surfacing machine comprising: a frame; a work table; means movably securing said work table to said frame for rotation about an axis; means to clamp a blade to be surfaced on said work table; a guide plate having a planar guide surface lying in a plane; means securing said guide plate to said frame for transverse movement relative to said axis; means for moving said guide plate relative to a blade on said work table in a direction perpendicular to said axis a honing member having a major portion of a planar honing surface in engagement with said planar guide surface on said guide plate; and means positioning said work table and said guide plate such that a blade clamped to said work table is engaged by the planar surface on the honing member upon movement of the honing member relative to the guide plate.

2. A blade surfacing machine comprising: a frame; a work table; means securing said work table to said frame for rotation about an axis lying in a reference plane; means to clamp a blade to be surfaced on said work table; means for rotating said work table about said axis and for locking said table in position at a selectable precise tilt angle with respect to said reference plane; a guide plate movably secured to said frame, said guide plate having a planar guide surface lying in a plane perpendicular to said reference plane; means for moving said guide plate in a direction parallel to said reference plane while maintaining said guide surface perpendicular to said reference plane; and a honing member having a planar honing surface movable in a direction parallel to said guide surface while maintaining a major portion of said honing surface in pressure contact with said guide surface and while maintaining part of the remaining portion of the honing surface in pressure contact with the blade clamped on the work table.

3. A blade surfacing machine comprising: a frame; a work table; means securing said work table to said frame for rotation about an axis lying in a reference plane; means to clamp a blade to be surfaced on said work table; means for rotating said work table about said axis and for locking said table in position at a selectable precise tilt angle with respect to said reference plane; a guide plate having a planar guide surface lying in a plane perpendicular to said reference plane; means for moving said guide plate in a direction parallel to said reference plane while maintaining said guide surface perpendicular to said reference plane; and a honing stone having a planar honing surface and means mounting said honing stone and imparting thereto rotational and alternately reversing transverse movement while maintaining a major portion of said honing surface in pressure contact with said guide surface, wherein said means moving said guide plate, comprises an incline lower surface on said guide plate bearing against a matingly inclined surface on said frame, and means to move said guide plate along the incline of said surface on said frame.

4. The surfacing machine as defined in claim 3 wherein said means to move comprises lead screw means between said frame and said guide plate.

5. The surfacing machine as defined in claim 4 wherein said means to move further comprises a motor driving said lead screw.

6. The surface machine as defined in claim 3 wherein said incline is lateral of said machine.

7. The surfacing machine as defined in any one of claims 3 or 4 or 5 or 6 wherein said means for rotating said work table comprises a pair of swing plates affixed to said work table at points intermediate the ends of said table said swing plates having peripheral surfaces formed as accurate circular arc segments centered about said axis and riding on roller members attached to said frame.

8. The surfacing machine as defined in claim 7 wherein said swing plates are driven in rotation about said axis by lead screw means.

9. A surfacing machine as defined in any one of claims 3 or 4 or 5 or 6 wherein said work table includes micrometer screw means for positioning adjustment of a blade mounted on said table for surfacing.

10. The blade surfacing machine as defined in claim 9 wherein said micrometer screw means bear against the bottom edge of said blade to adjust said blade with respect to said axis.

11. The surfacing machine as defined in any one of claims 3 or 4 or 5 or 6 wherein said clamp means comprises a clamping plate bearing against said blade and holding said blade against a surface of said work table and a clamping bar rotatably mounted at its ends in mounting blocks secured with respect to said work table, said clamping bar being rotatable to bear against said clamping plate and secure said blade to said work table beneath said clamping plate.

12. The surfacing machine as defined in claim 7 wherein said work table includes micrometer screw means for positioning adjustment of a blade mounted on said table for surfacing.

13. A surfacing machine as defined in claim 12 wherein said micrometer screw means bear against the bottom edge of said blade to adjust said blade with respect to said axis.

14. A blade surfacing machine comprising: a frame including a base plate member, a back plate member and two side plate members, a work table mounted for rotation about an axis extending between said side plate members and lying in a reference plane, means to clamp a blade to be surfaced on said work table, means for rotating said work table about said axis comprising a pair of swing plates affixed to said work table at points intermediate the ends of said table and having peripheral surfaces formed as accurate circular arc segments centered about said axis and riding on bearing members attached to said frame, said swing plates being driven in rotation about said axis by motor driven lead screw means, guide plate means having a planar guide surface lying in a plane perpendicular to said reference plane, a honing stone having a planar honing surface, means mounting said honing stone and imparting thereto rotational and alternately reversing transverse movement while maintaining a major portion of said honing surface of said stone in pressure contact with said guide surface, and means moving said guide plate in a direction parallel to said reference plane while maintaining said guide surface perpendicular to said reference plane to bring said honing surface into contact with said blade to be surfaced said means for moving comprising an inclined lower surface on said guide plate bearing against a matingly inclined upper edge surface on said back plate, said incline being lateral of said machine, and motor driven lead screw means to move said guide plate along said incline of said surfaces.

* * * * *